US005211707A

United States Patent [19]

Ditchek et al.

[11] Patent Number: 5,211,707

[45] Date of Patent: May 18, 1993

[54] SEMICONDUCTOR METAL COMPOSITE FIELD EMISSION CATHODES

[75] Inventors: Brian M. Ditchek, Milford, Mass.; Mark A. Neifeld, Tucson, Ariz.; John C. Gustafson, Harvard, Mass.

[73] Assignee: GTE Laboratories Incorporated, Waltham, Mass.

[21] Appl. No.: 728,444

[22] Filed: Jul. 11, 1991

[51] Int. Cl.[5] ..... H01J 9/12

[52] U.S. Cl. ..... 445/24; 445/50; 445/51; 437/200

[58] Field of Search ..... 445/24, 50, 51; 156/620.2, 620.3, 620.4; 437/200

[56] References Cited

U.S. PATENT DOCUMENTS

| | | | |
|---|---|---|---|
| 3,695,941 | 10/1972 | Green et al. | 156/620.2 |
| 3,720,856 | 3/1973 | Brody | 313/309 |
| 3,812,559 | 5/1974 | Spindt et al. | 445/50 |
| 3,998,678 | 12/1976 | Fukase et al. | 156/3 |
| 4,253,221 | 3/1981 | Cochran, Jr. et al. | 445/50 |
| 4,724,223 | 2/1988 | Ditchek | 437/200 |
| 4,984,037 | 1/1991 | Ditchek et al. | 357/22 |

FOREIGN PATENT DOCUMENTS

| | | | |
|---|---|---|---|
| 2-164786 | 6/1990 | Japan | 156/616.4 |

OTHER PUBLICATIONS

W. L. Ohlinger, "The Effect of . . . Parameters . . . High Field Electron Emitters . . . Uranium Dioxide-Tungsten Composites," Ph.D. Thesis, Aug. 1977, Georgia Institute of Technology.

C. A. Spindt et al., *J. Appl. Phys* 47 [12] 5248–63 (Dec. 1976).

M. von Allmen et al., "Structure of Laser-Produced Silicide Layers, Laser and Electron Beam Processing of Materials", pp. 524–529, Academic Press, Inc., 1980.

B. M. Ditchek, *J. Appl. Phys.* 57 [6] 1961–67 (1985).

"Cold Cathode=Hot Prospect", Technology update in *Advanced Materials & Processes,* Jul. 1986, p. 35.

B. M. Ditchek, *J. Crystal Growth* 75, 264–68 (1986).

B. M. Ditchek et al., *Appl. Phys Lett.* 49 [24] 1656–58 (1986).

B. M. Ditchek et al., *Extended Abstracts, 20th Conference on Solid State Devices and Materials,* Tokyo, 1988, pp. 77–80.

B. M. Ditchek et al., *Japanese J. Appl. Phys.* 27 [11] L2155–L2157 (1988).

B. M. Ditchek et al., *J. Appl. Phys.* 63 [6] 1964–70 (1988).

D. A. Kirkpatrick et al., Presentation and Publication, *Proc. 14th Int. Symp. on Discharges and Electrical Insulation in Vacuum,* Albuquerque, Sep. 1990.

B. M. Ditchek et al., *J. Crystal Growth 102,* 401–412 (1990).

*Primary Examiner*—Richard K. Seidel
*Assistant Examiner*—Jeffrey T. Knapp
*Attorney, Agent, or Firm*—Frances P. Craig

[57] ABSTRACT

A field emission cathode having a parallel array of individual electrically conductive rods of metal silicide or germanide in a silicon-based or germanium-based single crystal matrix. Each rod has an emission end exposed at one major surface of the cathode and an ohmic contact end exposed at an opposite major surface. In a preferred cathode, the matrix and rod materials are the constituents of a eutectic composition. The cathode is fabricated by a process involving producing a composite boule from a eutectic composition of a silicon-based or germanium-based material and a metal. The composite cathode body is cut from the boule so that the rods are generally normal to the major surfaces. Etching may be used to expose a uniform length of the rods at the emitting surface.

3 Claims, 4 Drawing Sheets

SEMICONDUCTOR METAL COMPOSITE FIELD EMISSION CATHODES

CROSS REFERENCE TO RELATED APPLICATIONS

This application contains subject matter related to matter disclosed and claimed in commonly assigned U.S Pat. Nos. 4,724,223 and 4,984,037, both incorporated herein by reference.

BACKGROUND OF THE INVENTION

This invention relates to field emission cathodes, and in particular to large-area field emission cathodes of semiconductor-metal eutectic composite materials.

High current density electron sources are required for a variety of laser and microwave tube applications. Development of the x-ray laser, in particular, requires high current density sources. At the present time this requirement is met by using thermionic cathodes, because of the high current densities possible with these devices. Unfortunately, thermionic cathodes are wasteful of power and cannot be turned on and off rapidly.

Field emission cathodes do not suffer from these drawbacks. Thus these "cold" cathodes would be attractive as possible alternatives to thermionic cathodes if reliable field emission cathode devices capable of yielding high current densities and high gross currents could be developed. However, prior to the present invention the necessary high current densities, gross currents, and long lifetimes have not been achieved in field emission cathodes.

Hopes for attaining field emission sources with currents and current densities equivalent to those of typical thermionic emitters have depended thus far on the development of multipin cathodes to yield high gross emission currents at low macroscopic fields. Spindt et al. (*J. Appl. Phys.*, 47, December 1976, p. 5248–63) have used lithographic techniques to prepare an array of thin film molybdenum cones on a silicon wafer in a low voltage emitter configuration. The largest arrays were 5000 pins at packing densities of $6\times10^5$ pins/cm$^2$. When operated in ultra-high voltage (UHV) conditions this multipin cathode achieved current densities of 8 A/cm$^2$ and maximum gross output current of 5 mA in direct current (dc) operation. However, the inability of Spindt et al. to prepare larger arrays and the thermal and mechanical instability of these structures prevents this approach from competing with thermionic emitters.

As an alternative to lithographic techniques, other researchers have used the rod-type structure formed upon solidification of a two-phase system that forms a eutectic in which the volume fraction of a conducting phase is much smaller than the volume fraction of the other phase. Eutectic cold cathodes of tungsten pins or rods in a matrix of uranium oxide have been the subject of the most extensive research. (See, for example, W. L. Ohlinger, Ph.D. Thesis, August 1977, Georgia Inst. of Technology.) Using a design in which the cathode and anode are separated by a vacuum gap, this eutectic cold cathode tested in UHV yielded current densities of up to 20 A/cm$^2$ under dc conditions using small-area arrays with a density of $10^7$ rods/cm$^2$. With larger cathode arrays, current densities of 1.2 A/cm$^2$ and gross output currents of 20 mA were obtained.

Thus, although both approaches developed cold cathodes that yielded attractive current densities, neither approach was able to develop the large gross currents necessary to compete with thermionic emitters. The low gross currents are due in part to inability to fabricate large area arrays. Spindt et al. were unable to produce Mo cone arrays with more than 5000 pins, while Ohlinger was plagued by the difficulties of growing the desired large boules of $W/UO_2$ composite. In addition to the difficulty presented by the high eutectic temperature of $W/UO_2$, the thermal expansion coefficient mismatches and inherent brittleness of the materials resulted in extensive internal cracking in the fabricated cathode devices.

For field emission cathode devices to become practical alternatives to thermionic cathodes, they must combine stability of device structure, high current density, and high gross current output. The present invention addresses this need.

SUMMARY OF THE INVENTION

In one aspect the invention is a field emission cathode including a composite body including a matrix of a silicon-based or germanium-based matrix material and an array of individual rods of an electrically conductive compound of silicon or germanium and a metal. The rods are distributed throughout the matrix and extend from a first major surface of the body to a second major surface of the body opposite the first major surface. The rods of the array are disposed generally parallel to each other and normal to the first and second major surfaces of the body, with the rods each having a first end thereof exposed for emission at the first major surface and a second end exposed for ohmic contact at the second major surface.

In a narrower aspect the matrix material and the electrically conductive compound are the constituents of a eutectic composition, and the mole ratio of the matrix material to the metal in the body is approximately equal to the mole ratio of the matrix material to the metal in the eutectic composition.

In another aspect the invention is a process for producing a field emission cathode involving producing a composite boule from a eutectic composition of a silicon-based or germanium-based material and a metal. The composite boule includes a matrix of the silicon-based or germanium-based material and an array of individual rods of an electrically conductive compound of silicon or germanium and the metal. The mole ratio of the silicon-based or germanium-based material to the metal in the boule is approximately equal to the mole ratio of the silicon-based or germanium-based material to the metal in the eutectic composition. The rods of the array are distributed throughout the matrix, and are disposed generally parallel to each other. A composite body is cut from the boule. The rods of the array in the body extend from a first major surface of the body to a second major surface of the body opposite the first major surface and are disposed generally normally to the first and second major surfaces of the body. The rods each have a first end thereof exposed for emission at the first major surface and a second end exposed for ohmic contact at the second major surface.

In narrower aspects a portion of the body is etched to expose the first ends of the rods at the first major surface, or is etched to expose the first ends of the rods at the first major surface and to produce a conical shape in the first ends.

BRIEF DESCRIPTION OF THE DRAWINGS

For a better understanding of the present invention, together with other objects, advantages and capabilities thereof, reference is made to the following Description and appended claims, together with the Drawings, in which:

DETAILED DESCRIPTION OF THE PREFERRED EMBODIMENTS

Figure 1:
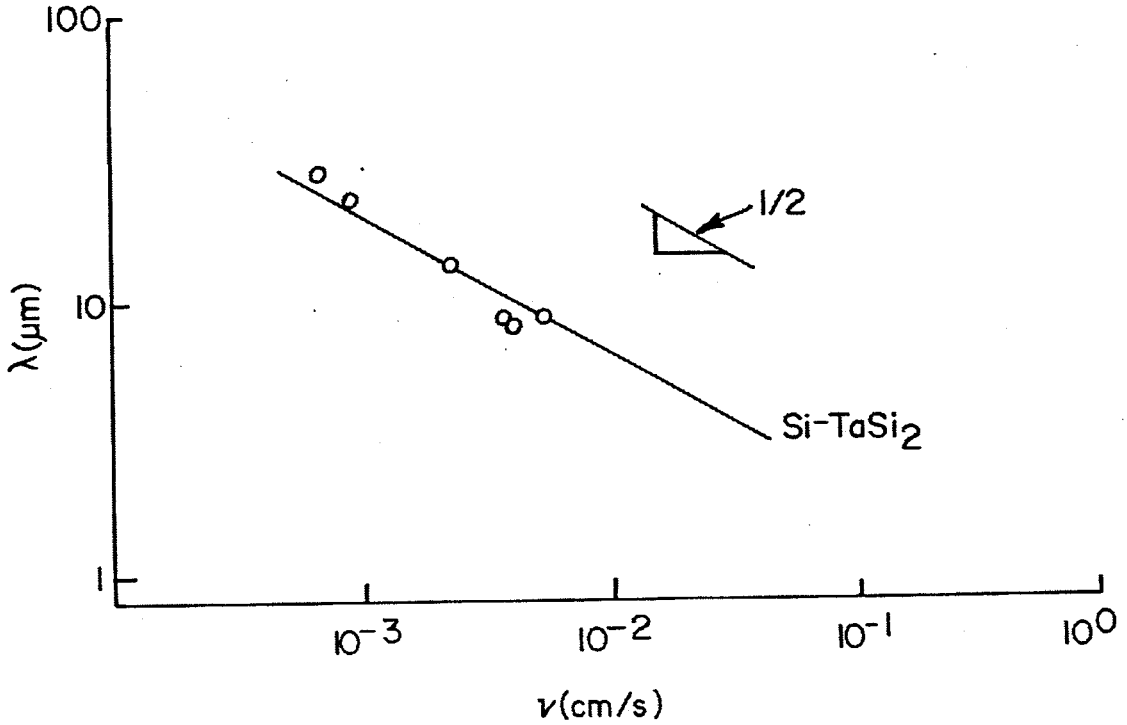
FIG. 1 illustrates the relationship between the growth rate of the semiconductor-metal eutectic material in accordance with one embodiment of the invention and the interrod spacing.

The exemplary field emission cathodes described herein are fabricated from a two-phase silicon/silicide semiconductor/metal eutectic composition prepared by eutectic solidification methods. The silicon/silicide compositions referred to herein may be any semiconductor/metal eutectic compositions of silicon and a silicide which will, on eutectic solidification, form separate phases of metallic silicide pins or rods permeating a silicon semiconductor matrix, preferably but not necessarily a single crystal matrix. Such compositions include, but are not limited to, other silicon/metal silicide compositions, for example $Si/TaSi_2$, $Si/WSi_2$, $Si/MoSi_2$, $Si/NbSi_2$, $Si/ZrSi_2$, and $Si/CrSi_2$. Also suitable for use in the devices described herein are germanium/metal germanide semiconductor-metal eutectic composites, for example $Ge/TiGe_2$, $Ge/ZrGe_2$, or $Ge/NdGe_{1.6}$ A charge containing the desired constituents is melted in a suitable crucible. The constituent proportions are selected to be appropriate to the eutectic composition of the semiconductor material and the conductor compound, i.e. the mole ratio of the matrix material to the metal in the melt is approximately equal to the mole ratio of the matrix material to the metal in the eutectic composition and thus in the boule. The melt is then solidified unidirectionally to form a semiconductor matrix including a conductive phase.

The semiconductor (matrix) material of the melt may, if desired, be doed in known manner with conductivity imparting material of either N- or P-type so that Schottky barriers are formed between the conductive rods and the semiconductor matrix. The matrix material for the exemplary devices described herein is a doped silicon semiconductor material. However, undoped material may be utilized for the devices described herein.

When the matrix material is silicon, germanium, or a similar material, the technique called the Czochralski method for growing silicon single crystals may be employed to produce large diameter boules of the desired Si/silicide eutectic cathode materials, e.g. up to about 6 in. This crystal growing method is described by J. C. Brice ("Growing Crystals from the Melt," John Wiley & Son, Inc., N.Y. 1965, Vol. 5 of *Selected Topics in Solid State Physics*, E. P. Wohlfarth, Ed.).

More specifically, the Czochralski crystal growth technique may be suitably employed to perform the unidirectional solidification step to form the semiconductor/conductor composite material. A single crystal seed of the semiconductor material is lowered into contact with the molten surface of the eutectic composition charge, and the seed is slowly pulled upward. A boule of a composite of the semiconductor material and the conductive material that forms a eutectic with the semiconductor material is produced, in which the semiconductor material is in the form of a single crystal matrix with rods of the conductive material disposed throughout the matrix. The matrix of semiconductor material is of the same crystal orientation as the seed crystal, and the rods extend generally parallel to the direction of pulling.

The achievement of a single crystal matrix in the growth of the eutectic material provides an advantage in the fabrication of the emitter devices described herein. Specifically, the single crystal matrix morphology makes possible a more even height in the emitter rods than has been achieved by prior art technologies, particularly when the matrix is etched to expose the emitter tips. Thus the electric field produced at the surface of each tip and the turn-on current for each tip are the same, permitting even emission from the tips. This even emission is important to the achievement of an efficient emitter and long life in the emitter device, since sequential burnout of groups of emitter tips of varying heights is avoided.

Alternatively, other methods for growing eutectic compositions may be employed to fabricate a silicon/silicide or other semiconductor/conductor cathode material having the preferred single crystal matrix and a high rod density. Known are such alternate methods as float zone growth as used for growth of Si, described by Brice (supra); pulsed laser processing, using a Q-switched Nd-glass laser, of a Si wafer with a $Si/WSi_2$, eutectic composition, described by M. von Allmen et al. (Laser and Electron Beam Processing of Materials, C. W. White and P. S. Peercy, eds, Academic Press, N.Y. (1980), pp. 524–9); and the Bridgman growth technique as described by Ditchek for the growth of Si/TiGe (*J. Appl. Phys.* 57, 1961 (1985)). Brice, Ditchek et al., von Allman et al., and Ditchek are all incorporated herein by reference.

The following description is generally directed to a $Si/TaSi_2$ eutectic composition as exemplary of a suitable material for the field emission cathodes described herein. A charge containing the desired constituents in proportions appropriate to the silicon/tantalum eutectic composition is melted in a suitable crucible. The $Si/TaSi_2$ composite material is formed using the Czochralski technique. A single crystal seed of silicon is lowered into contact with the molten surface of the silicon-tantalum charge, and the seed is slowly pulled upward. Normally, both the seed crystal and melt crucible are slowly rotated in opposite directions, each at a rate of about 6 rpm, to provide temperature uniformity. A boule of a composite of the silicon and the tantalum silicide conductive material is produced in the form of a single crystal silicon matrix with tods of the conductive tantalum silicide material disposed throughout the matrix. The matrix is of the same crystal orientation as the silicon seed crystal, and the tantalum silicide rods extend generally parallel to the direction of pulling, i.e. parallel to the axis of the boule. Just as in conventional semiconductor growth, the conductivity of the matrix, as well as the conductivity type, are determined by the amount of Group III or Group V elements, e.g. gallium or arsenic, present in the charge.

The volume fraction of the rods achieved by eutectic solidification depends on the specific eutectic material system being solidified, preferably corresponding to about 0.5–35 volume percent, and in the case of a Si/-$TaSi_2$ system to about 2 volume percent. The density and interrod spacing of the eutectic material depend on the growth rate according to the equation, $\lambda = Av^{-\frac{1}{2}}$, where $\lambda$ is the rod spacing, A is a constant for a particular system, and v is the growth rate, for example the rate at which the seed crystal is pulled upward in the Czochralski crystal growth technique. A plot of log $\lambda$ vs log v is shown in FIG. 1 for the Si/$TaSi_2$ system. For a 20 cm/h growth rate, the rod density, $1/\lambda^2$, is about $2\times10^6$ rods/cm$^2$. This approaches the highest density achievable using the Czochralski crystal growth technique. For this silicon-based system and other systems, more rapid growth rates and higher rod densities may be possible using growth techniques other than the Czochralski method. Float zone growth of silicon can be performed at rates up to 200 cm/h, which applied to the Si/$TaSi_2$ system yields rod densities up to $2\times10^7$. Von Allmen et al. (supra) have shown that $WSi_2$ pin densities as high as $10^{10}$ rods/cm$^2$ can be achieved by pulsed laser processing of a silicon wafer with a tungsten film on its surface such that the molten zone achieved with the laser has a composition near the Si/$WSi_2$ eutectic composition.

Figure 2:
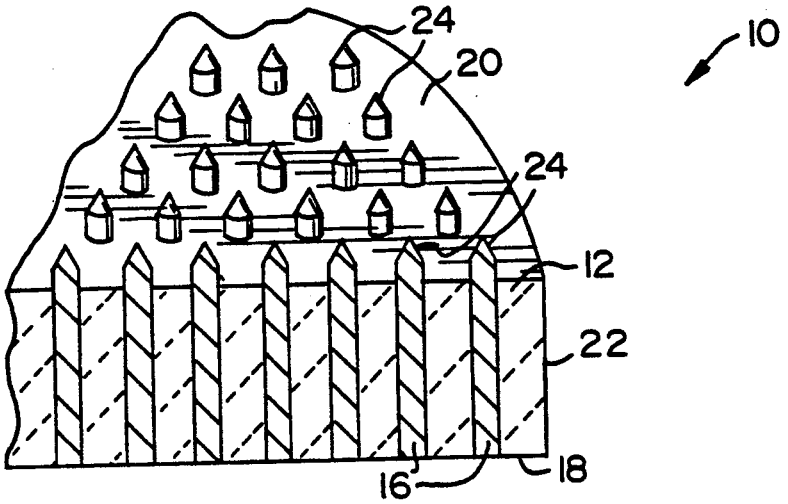
FIG. 2 schematically illustrates a cathode produced from an etched wafer of semiconductor-metal eutectic composite material in accordance with one embodiment of the invention.

FIG. 2 is a schematic illustration of a cathode device, showing a portion of a slice or wafer cut from a composite boule grown as described above. The boule is cut transverse to its axis, and the wafer selectively etched to expose the tips of the rods perpendicular to and near the surface of the wafer. Although etching of the wafer to expose the emitter tips is preferred, it has been found that the devices described herein will also emit efficiently in unetched form. Most preferred are devices etched sufficiently to produce conical emitter tips, as shown in FIG. 2. The preferred rod diameter is 500Å to 15 μm. Pin densities of $10^5-10^{10}$ cm$^{-2}$ are preferred, and the preferred spacing between adjacent rods is from 100Å to 50 μm. The preferred volume fraction of rods in the body is about from 0.5–35%. The preferred height of the exposed tips in the etched samples is about 10–20 μm. If the matrix material is doped, the preferred semiconductor carrier concentration is about $10^{-}-10^{18}$ per cm$^3$.

In FIG. 2, cathode 10 includes wafer body 12 having matrix 14 of single crystal semiconductor material and an array of rods 16 of the conductive material which forms the eutectic composition with the semiconductor material. Body 12 includes lower major surface 18, upper major surface 20, side surface 22, and exposed tips 24 of rods 16 extending from upper surface 20. Within matrix 14, each rod 16 extends generally perpendicularly from lower surface 18 to upper surface 20. Rod tips 24 serve as the emitter tips for the device. Rods 16 are shown for the purpose of illustration as having a circular cross-section and as parallel to one another, but are not necessarily of perfect circular cross-section nor are they necessarily perfectly parallel. Each rod 16 is, however, an individual conductive element not interconnected to other rods 16, and is surrounded by continuous semiconductor matrix 14.

Figure 3A:
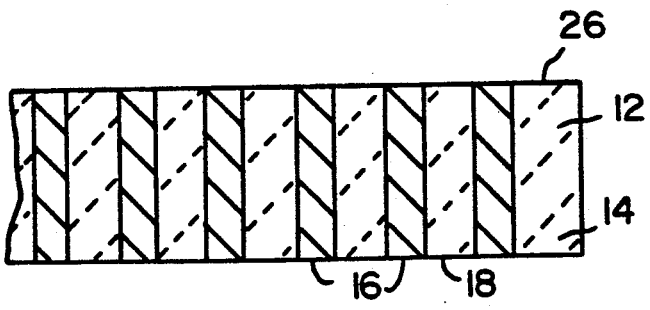
FIGS. 3*a*–3*c* schematically illustrate stages in the fabrication of a device in accordance with one embodiment of the invention.
Figure 3B:
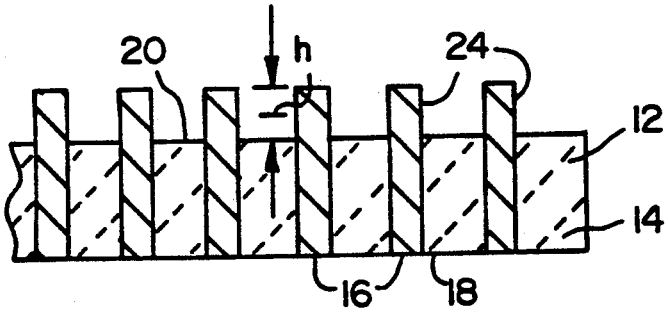
Figure 3C:
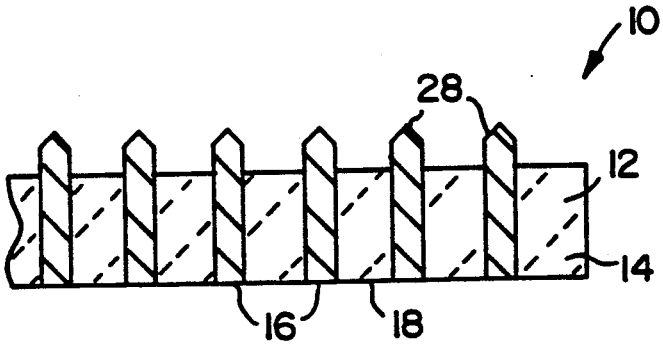

FIGS. 3*a*–3*c* schematically illustrate stages in the fabrication of an illustrative field emission cathode device. FIG. 3*a* shows wafer body 12 as cut from a boule prepared as described above. Unetched upper surface 26 of body 12 is polished to produce a planar surface, as shown in FIG. 3*a*, then etched to remove matrix material to a depth "h" exposing rod tips 24 to height "h" as shown in FIG. 3*b*. The etchant is selected to etch only the matrix material, leaving the rod material unetched. Rod tips 24 are further etched to produce cathode device 10 having conical emitter tips 28, as shown in FIG. 3*c*. Alternatively, a single etchant may be selected to slightly etch rod tips 24 to produce conical emitter tips 28 simultaneously with the matrix etching step.

Figure 4:
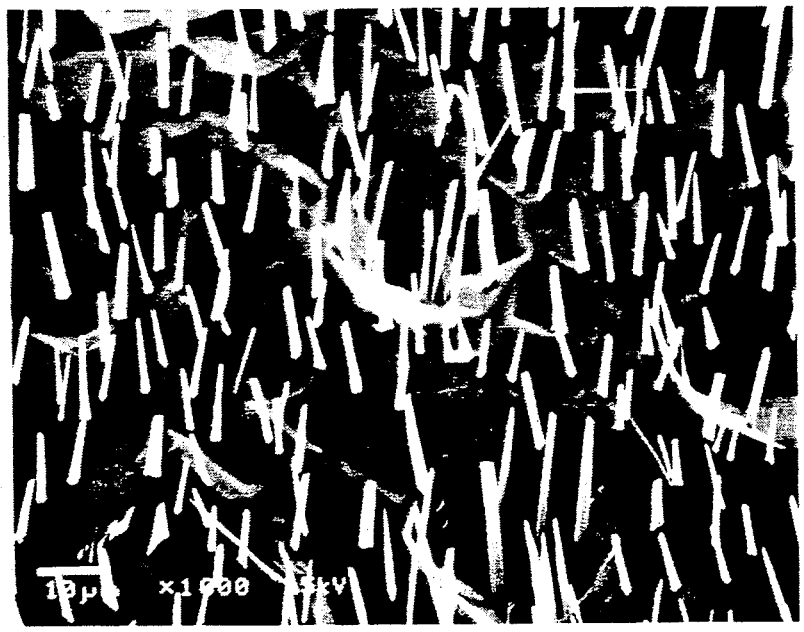
FIG. 4 is a photomicrograph of an etched wafer of semiconductor-metal eutectic composite material in accordance with one embodiment of the invention, illustrating a high density of emission sites and a typical emitter tip structure.

FIG. 4 is a photomicrograph of an actual Si/$TaSi_2$ composite wafer prepared as described above, etched to expose the rods, and further etched to produce the preferred conical Ta—$Si_2$ emitter tips.

Figure 5:
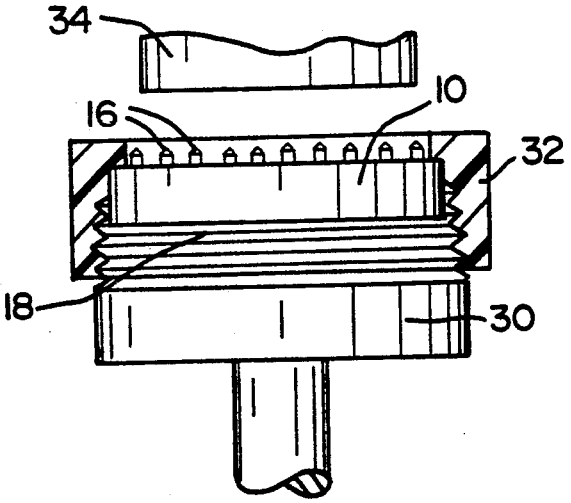
FIG. 5 schematically illustrates typical apparatus for operation of a cathode in accordance with one embodiment of the invention.

For operation of the cathode, electrical contact to rods 16 at lower surface 18 is straightforward, for example as shown in FIG. 5. Cathode device 10 rests without bonding on electrically conductie holder 30 which acts both as the cathode source and as a holder for cathode 10. Conveniently, electrically insulating support ring 32 may be threaded onto holder 30 to secure cathode 10 against holder 30. Alternatively, lower surface 18 of cathode 10 may be coated with or adhered to an electrically conductive contact layer, e.g. a conductive yttrium, titanium, zirconium, niobium, tantalum, chromium, molybdenum, tungsten, cobalt, nickel, or platinum silicide or germanide in low electrical resistance ohmic contact with the lower ends of rods 16. Also alternatively, lower surface 18 may be bonded to holder 30 using an electrically conductive material such as a metal alloy.

Conventional anode 34 may then be positioned directly above and spaced apart from cathode 10. Holder 30 and anode 34 may be any conductive material, e.g. steel, while ring 32 may be any electrically insulating material sufficiently rigid to position and stabilize the cathode, e.g. a fluorinated hydrocarbon polymer. A conventional gap may be selected between anode 34 and cathode 10, e.g. ranging between about 0.1 mm and 5 mm, depending on the desired operating voltage. Typically, operation of the field emission cathode is carried out in a vacuum, e.g. at least $10^{-2}$ torr or higher.

The following Examples are presented to enable those skilled in the art to more clearly understand and practice the present invention. These Examples should not be considered as a limitation upon the scope of the present invention, but merely as being illustrative and representative thereof.

EXAMPLES

Field emission cathode wafers were prepared from a Si/$TaSi_2$ eutectic composition by the Czochralski crystal pulling technique. A charge of Si-5.5% Ta by weight, corresponding to the desired eutectic composition, was melted in a quartz crucible. The melt was doped with phosphorus to about $10^{15}$ atoms/cc. A single crystal of silicon, used as the seed, was allowed to just contact the melt surface, and the seed crystal and the crucible were each rotated relative to the other at 6 rpm. The seed crystal was withdrawn slowly at a controlled rate of 20 cm/hr as the melt crystallized at the crystal/melt interface. This growth produced a boule of a composite material having a silicon matrix and $TaSi_2$ rods oriented within the matrix parallel to the growth direction.

The volume fraction of the rods for this $Si/TaSi_2$ system corresponded to about 2 volume percent. The rod densities, $1/\lambda^2$, of several samples of this material prepared at different growth rates are shown in the Table below.

Composite cathode samples were then prepared from wafers cut from the boule. The emitting surface of wafers 0.025 inches thick and about 0.5 inches in diameter were polished with colloidal silica and were etched using NaOCl/NaOH or $Hf/HNO_3$ etching solutions to vary the shape of the rods and their height above the Si surface. An unetched cathode sample of the same dimensions was also prepared.

The prepared cathodes were mounted as shown in FIG. 5. Each prepared wafer was positioned without bonding on an electrically conductive steel holder which provided both the cathode source and a mounting block for the cathode. A Teflon® ring was threaded onto the steel holder to secure the cathode and press it firmly against the holder.

The mounted cathodes were tested in a bell jar vacuum system at a pressure of $5\times10^{-6}$ torr. An anode was positioned 0.5–0.25 m from the cathode surface, as shown in the Table. The anode area, 0.32 $cm^3$, was smaller than the cathode area, 0.8 $cm^2$. Consequently, all measured currents were divided by the anode area to yield current densities. Control samples of single crystal Si and steel were also tested under the same conditions. No measurable currents resulted from these control samples.

TABLE

| Sample | Rod Shape | Spacing, rods/$cm^2$ | Anode Gap, cm |
|---|---|---|---|
| A | conical | $10^6$ | 0.05 |
| B | matrix not etched | $10^6$ | 0.025 |
| C | matrix etched, rod shape not recorded | $10^6$ | 0.025 |
| D | cylindrical | $10^5$ | 0.05 |

Figure 6:
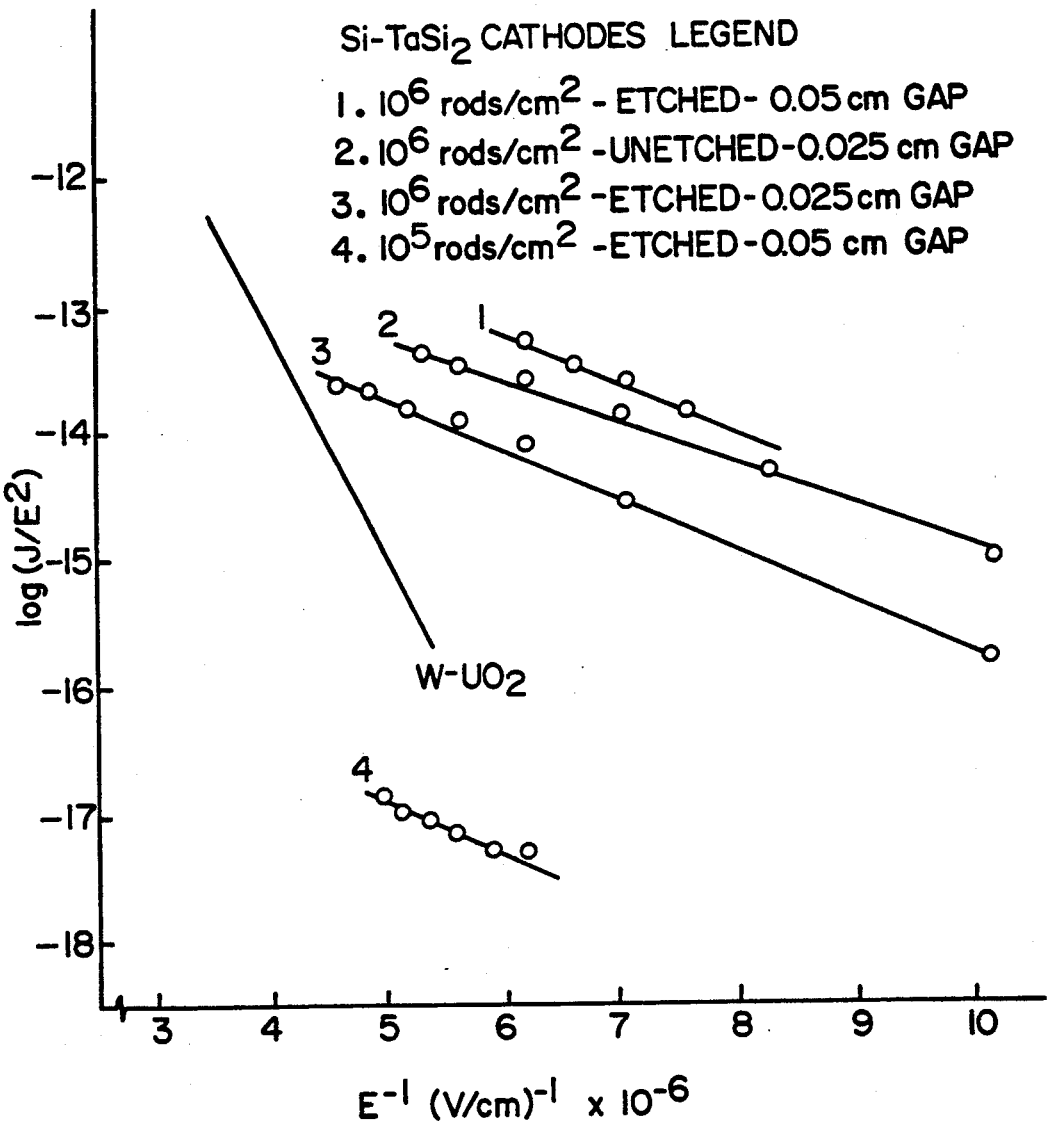
FIG. 6 is a Fowler-Nordheim plot illustrating the relationship between the emission current and the macroscopic electric field in devices in accordance with various embodiments of the invention and in a control device.

The results are illustrated in FIG. 6, in which the data is plotted to show accord with the Fowler-Nordheim equation:

$$J = \frac{A(\beta E)^2}{\phi t^2(y)} \exp\left(-B\frac{\phi^{3/2}v(y)}{\beta E}\right) A/cm^2 \quad (1)$$

where J is the Fowler-Nordheim emission density, A and B are constants, E is the applied electric field, $\beta$ is the field enhancement factor due to local geometry, $\phi$ is the work function of the mission material, and t(y) and v(y) are very weak functions of the work function and electric field. (R. H. Fowler and L. W. Nordheim, Proc. R. Soc. Lond., A119, 1173 (1928).) Data from Ohlinger (supra) on the $W/UO_2$ cathodes operated using an equivalent cathode spacing are included in FIG. 6 for reference.

The linearity of the results shows that the $Si/TaSi_2$ composite cathodes follow the Fowler-Nordheim relationship expected for field emitters. The semiconductor-metal eutectic cathodes with higher rod densities yielded substantially more emission than the lower rod density cathode. As shown in FIG. 6, the unetched flat cathodes yielded similar emission currents to the deeply etched cathodes.

FIG. 6 also shows that the $Si/TaSi_2$ composites yielded significantly better emission than the $W/UO_2$. As a further example, in another test at a gap of 0.025mm and an applied voltage of 4 KV the $Si/TaSi_2$ cathode emitted 1 $mA/cm^2$ compared to the $10^{-2}$ $mA/cm^2$ emitted by the $W/UO_2$ cathode.

Optimization of conditions such as higher vacuum, smaller gaps, higher density rod structures and higher applied voltages further increase the maximum emission over those shown herein. For example, by using higher applied voltages and a smaller gap Ohlinger (supra) increased current densities from the $10^{-2}$ $mA/cm^2$ to a maximum reported value of 1.2 $A/cm^2$. Comparable increases in the emission characteristics of the $Si/TaSi_2$ composites will yield a current density of 100 $A/cm^2$ and a gross current of 100 A.

One important advantage of the cathode device described herein and of other silicon/silicide and germanium/germanide systems is that the composite materials can be grown over a large range of growth rates to yield rod densities as high as $10^{10}$ rods/$cm^2$. Since emission increases with rod density, even larger emission currents and current densities than those above may be easily achieved with composites grown at more rapid growth rates.

The ease of processing of these cathodes presents a further important advantage, in that very large area cathodes may be produced, resulting in large gross currents even at a low current density.

The achievement of a single crystal matrix in the growth of the eutectic material is also an advantage, as mentioned above. The single crystal matrix morphology makes possible a more even height in the emitter rods, resulting in uniformity in the electric field produced at the surface of each tip and the turn-on current for each tip. The resulting even emission from the tips results in greater efficiency and long life in the emitter device.

The novel cold cathodes described herein present many other advantages over those of the prior art, particularly over the Mo/Si and $W/UO_2$ devices mentioned above. The eutectic material of the device exhibits an inherently high packing density, exhibiting a higher number of emitting tips per unit area which results in a higher emission current. Also, because the cathode does not depend on the adhesion of a metallic film, as does the molybdenum cone on silicon approach, but rather has metallic rods that permeate a silicon matrix, the cathode is more structurally sound than the Mo/Si approach. These cold cathodes are more robust than those of the prior art also because of the inherent thermal and fabrication-related properties of the material. Also the novel cathodes yield more current at a given field strength when compared under similar conditions to those of the prior art.

While there has been shown and described what are at present considered the preferred embodiments of the invention, it will be obvious to those skilled in the art that various changes and modifications can be made therein without departing from the scope of the invention as defined by the appended claims.

We claim:

1. A process for producing a field emission cathode comprising the steps of:

producing, from a eutectic composition of a silicon-based or germanium-based material and a metal, a composite boule comprising a matrix of said silicon-based or germanium-based material and an array of individual rods of an electrically conductive compound of silicon or germanium and said metal, wherein the mole ratio of said silicon-based or germanium-based material to said metal in sad boule is approximately equal to the mole ratio of said silicon-based or germanium-based material to said metal in said eutectic composition, said rods of said array are distributed throughout said matrix, and said rods of said array are disposed generally parallel to each other;

cutting from said boule a composite body in which said rods of said array extend from a first major surface of said body to a second major surface of said body opposite said first major surface and are disposed generally normally to said first and second major surfaces of said body, with said rods each having a first end thereof exposed for emission at said first major surface and a second end exposed for ohmic contact at said second major surface; and etching a portion of said body to expose said first ends of said rods at said first major surface.

2. A process in accordance with claim 1 wherein said matrix is a single crystal material.

3. A process for producing a field emission cathode comprising the steps of:

producing, from a eutectic composition of a silicon-based or germanium-based material and a metal, a composite boule comprising a matrix of said silicon-based or germanium-based material and an array of individual rods of an electrically conductive compound of silicon or germanium and said metal, wherein the mole ratio of said silicon-based or germanium-based material to said metal in sad boule is approximately equal to the mole ratio of said silicon-based or germanium-based material to said metal in said eutectic composition, said rods of said array are distributed throughout said matrix, and said rods of said array are disposed generally parallel to each other;

cutting from said boule a composite body in which said rods of said array extend from a first major surface of said body to a second major surface of said body opposite said first major surface and are disposed generally normally to said first and second major surfaces of said body, with said rods each having a first end thereof exposed for emission at said first major surface and a second end exposed for ohmic contact at said second major surface; and etching a portion of said body to expose said first ends of said rods at said first major surface, and to produce a conical shape in said first ends.

* * * * *